US008330778B2

(12) United States Patent
Song et al.

(10) Patent No.: US 8,330,778 B2
(45) Date of Patent: Dec. 11, 2012

(54) MONITOR

(75) Inventors: Yong-Jun Song, Shenzhen (CN); Wu Meng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 573 days.

(21) Appl. No.: 12/564,050

(22) Filed: Sep. 22, 2009

(65) Prior Publication Data

US 2011/0037757 A1 Feb. 17, 2011

(30) Foreign Application Priority Data

Aug. 12, 2009 (CN) ..... 2009 1 0305532

(51) Int. Cl.
*G09G 5/10* (2006.01)
*G09G 5/00* (2006.01)

(52) U.S. Cl. ..... 345/690; 345/207; 345/211

(58) Field of Classification Search ..... None
See application file for complete search history.

(56) References Cited

U.S. PATENT DOCUMENTS

2007/0287539 A1* 12/2007 Wu ..... 463/36
2008/0238902 A1* 10/2008 Huang ..... 345/204
2009/0160541 A1* 6/2009 Liu et al. ..... 327/544
2009/0207122 A1* 8/2009 Cheng et al. ..... 345/102
2012/0025999 A1* 2/2012 Needham et al. ..... 340/686.6

* cited by examiner

*Primary Examiner* — Andrew L Sniezek
(74) *Attorney, Agent, or Firm* — Altis Law Group, Inc.

(57) ABSTRACT

A monitor includes a microprocessor, a switch control unit, and a switch detecting unit receiving a system voltage and sending the system voltage to the microprocessor. When the microprocessor detects the presence of the system voltage, and the microprocessor outputs a first control signal to the switch control unit, to control the monitor to be turned on. When the microprocessor detects the system voltage not being present, and the microprocessor outputs a second control signal to the switch control unit, to control the monitor to be turned off.

7 Claims, 2 Drawing Sheets

MONITOR

BACKGROUND

1. Technical Field

The present disclosure relates to a monitor.

2. Description of Related Art

Computers, media players, and other electronic devices display information to users on monitors. However, conventionally, a host computer and a monitor are turned on or turned off by different switches. When the host computer is powered off, the monitor could be still on. The users usually forget to turn off the monitors after they shut down the computers, resulting in wasting the electrical energy and further ageing the components in the monitor.

DETAILED DESCRIPTION

Figure 1:
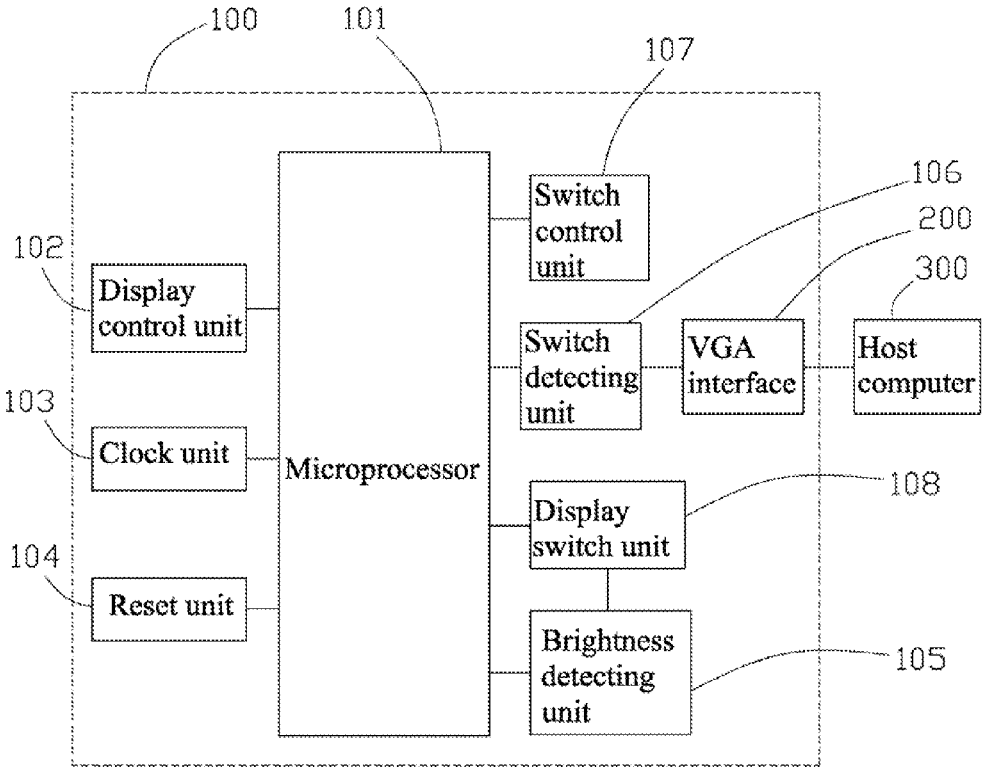
FIG. 1 is a block diagram of an embodiment of a monitor connected to a host computer.

Referring to FIG. 1, an exemplary embodiment of a monitor 100 is connected to a host computer 300 via a display interface, such as a video graphics array (VGA) interface 200, to receive video signals output from the host computer 300 for displaying. The monitor 100 includes a microprocessor 101, a display control unit 102, a clock unit 103, a reset unit 104, a brightness detecting unit 105, a switch detecting unit 106, a switch control unit 107, and a display switch unit 108. The display control unit 102 regulates the brightness of the monitor 100. The switch control unit 107 controls the monitor 100 to be turned on or turned off. The display control unit 102 and the switch control unit 107 are known circuits of a current monitor. In one embodiment, the microprocessor 101 is a single-chip, and the type of the microprocessor 101 is AT89C51.

The clock unit 103 provides clock signals to the microprocessor 101. The reset unit 104 resets the microprocessor 101. The brightness detecting unit 105 detects an environment brightness state around the monitor 100 and sends the environment brightness state to the microprocessor 101. The microprocessor 101 compares the received environment brightness state with a current brightness state of the monitor 100 output from the display control unit 102, and outputs a control signal to the display control unit 102, to regulate the brightness of the monitor 100. If the environment brightness is dark, the brightness of the monitor 100 changes to bright. The images and characters displayed on the monitor 100 are bright, eyes of the user could be harmed. The microprocessor 101 outputs a first brightness control signal to the display control unit 102, to reduce the brightness of the monitor 100. When the environment brightness is bright, the brightness of the monitor 100 changes to dark. If images and characters displayed on the monitor 100 are dark, eyes of the user will get tired easily. The microprocessor 101 outputs a second brightness control signal to the display control unit 102, to improve the brightness of the monitor 100.

The switch detecting unit 106 receives a system voltage 5V_SYS output from the host computer 300 via the VGA interface 200, and outputs the system voltage 5V_SYS to the microprocessor 101. If the microprocessor 101 detects the presence of the system voltage 5V_SYS, and the microprocessor 101 will output a first control signal to the switch control unit 107, to control the monitor 100 to be turned on. If the microprocessor 101 detects the system voltage 5V_SYS not being present, and the microprocessor 101 will output a second control signal to the switch control unit 107, to control the monitor 100 to be turned off.

When the monitor 100 works, the switch detecting unit 106 detects whether the user of the computer exists in front of the monitor 100 via an infrared sensor. If the user does not exist in front of the monitor 300, the system voltage 5V_SYS from the host computer 300 is reduced by the switch detecting unit 106 to a low level, to be provided to the microprocessor 101. The microprocessor 101 outputs the second control signal to the switch control unit 107, to control the monitor 100 to be turned off. If the user exists in front of the monitor 100, the microprocessor 101 receives the system voltage 5V_SYS output from the host computer 300. The microprocessor 101 outputs the first control signal to the switch control unit 107, to control the monitor 100 to be turned off to return work. The display switch unit 108 includes an operation switch, to control the monitor 100 to be turned on or turned off by manual operation.

Figure 2:
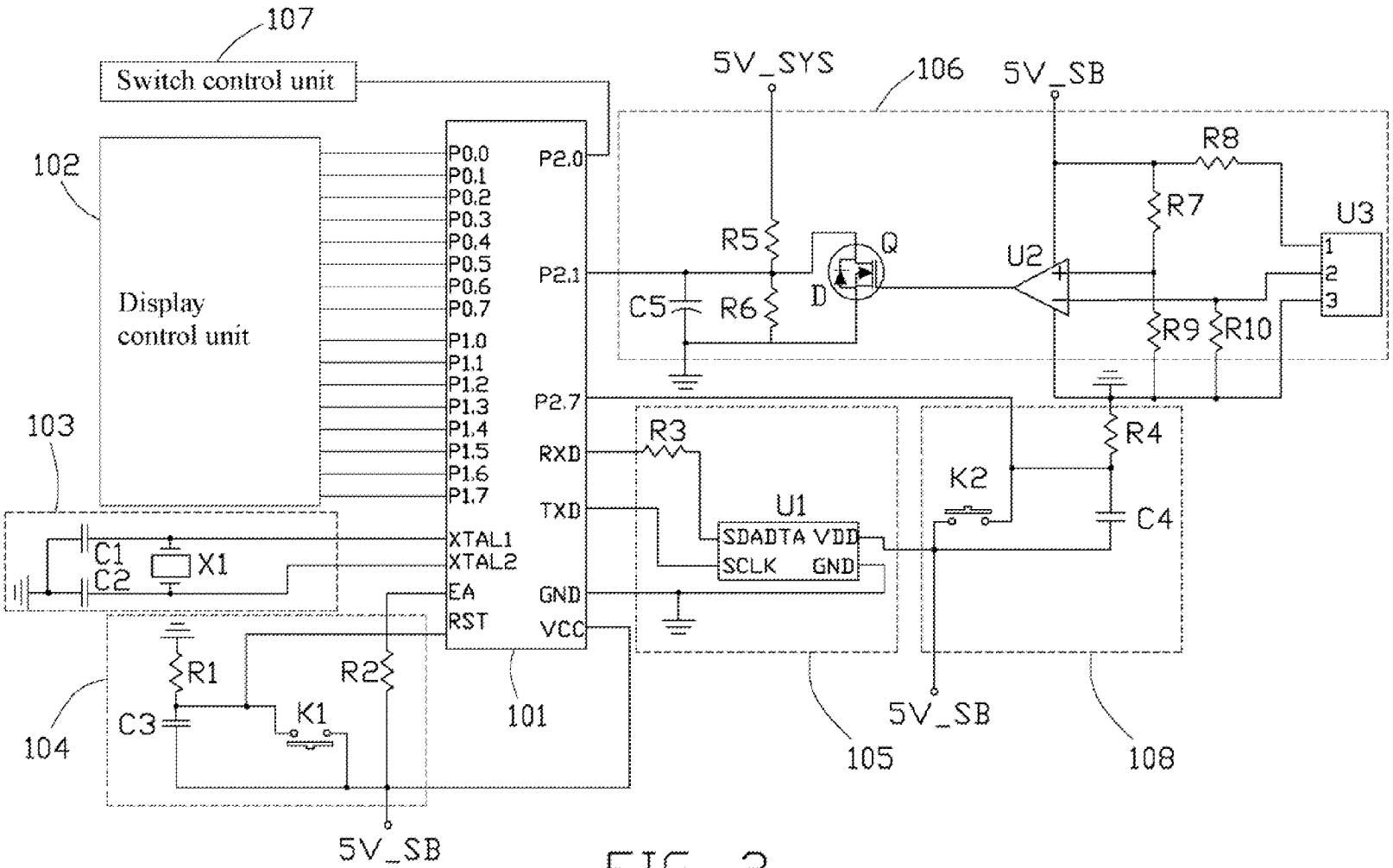
FIG. 2 is a circuit diagram of the monitor of FIG. 1.

Referring to FIG. 2, the clock unit 103 includes a crystal oscillator X1 and capacitors C1 and C2. A first clock pin XTAL1 of the microprocessor 101 is grounded via the capacitor C1. A second clock pin XTAL2 of the microprocessor 101 is grounded via the capacitor C2. The crystal oscillator X1 is connected between the first clock pin XTAL1 and the second clock pin XTAL2 of the microprocessor 101.

The reset unit 104 includes a switch K1, a capacitor C3, and resistors R1 and R2. A power pin EA of the microprocessor 101 is connected to an inside power 5V_SB of the monitor 100 via the resistor R2. A voltage pin VCC of the microprocessor 101 is connected to the inside power 5V_SB and grounded via the capacitor C3 and the resistor R1 in sequence. A first terminal of the switch K1 is connected to a node between the capacitor C3 and the resistor R1. A second terminal of the switch K1 is connected to the inside power 5V_SB.

The brightness detecting unit 105 includes a brightness sensor U1 and a resistor R3. A receiving pin RXD of the microprocessor 101 is connected to a data pin SDADTA of the brightness sensor U1 via the resistor R3. A transmitting pin TXD of the microprocessor 101 is connected to a clock pin SCLK of the brightness sensor U1. A voltage pin VDD of the brightness sensor U1 is connected to the inside power 5V_SB. A ground pin of the brightness sensor U1 is connected to a ground pin of the microprocessor 101 and grounded. In one embodiment, the type of the brightness sensor U1 is TSL2550.

The display switch unit 108 includes a switch K2, a capacitor C4, and a resistor R4. An input/output pin P2.7 of the microprocessor 101 is connected to the inside power 5V_SB via the switch K2. The inside power 5V_SB is grounded via the capacitor C4 and the resistor R4 in sequence. The input/output pin P2.7 of the microprocessor 101 is also connected to a node between the capacitor C4 and the resistor R4. The switch K2 is formed on the monitor 100, and can be operated manually.

The switch detecting unit 106 includes a capacitor C5, a field effect transistor (FET) Q, a diode D, an amplifier U2, an infrared sensor U3, and resistors R5-R10. An input/output pins P2.1 of the microprocessor 101 is grounded via the capacitor C5, connected to the system voltage 5V_SYS via the resistor R5, and connected to the drain of the FET Q. The source of the FET Q is grounded. The resistor R6 is connected between the input/output pin P2.1 of the microprocessor 101 and the source of the FET Q. An anode of the diode D is connected to the source of the FET Q. A cathode of the diode D is connected to the drain of the FET Q. The gate of the FET Q is connected to an output terminal of the amplifier U2. A voltage terminal of the amplifier U2 is connected to the inside power 5V_SB. The resistors R7 and R9 are connected in series, and connected between the voltage terminal and a ground terminal of the amplifier U2. A non-inverting input terminal of the amplifier U2 is connected to a node between the resistors R7 and R9. An inverting input terminal of the amplifier U2 is connected to a second pin 2 of the infrared sensor U3 and grounded via the resistor R10. The ground pin of the amplifier U2 is connected to a third pin 3 of the infrared sensor U3, and grounded. A first pin 1 of the infrared sensor U3 is connected to the voltage terminal of the amplifier U2 via the resistor R8. The switch control unit 107 is connected to an input/output pin P2.0 of the microprocessor 101. Input/output pins P0.0-P0.7 and P1.0-P1.7 of the microprocessor 101 are connected to the display control unit 102. In one embodiment, the type of the infrared sensor U3 is RE200B.

When the host computer 300 is powered on, the host computer 300 outputs the system voltage 5V_SYS to the microprocessor 101 via the VGA interface 200. The microprocessor 101 detects the presence of the system voltage 5V_SYS, the switch K2 is turned on. The microprocessor 101 outputs the first control signal to the switch control unit 107, to turn on the monitor 100. When the host computer 300 is powered off, the microprocessor 101 detects no presence of the system voltage 5V_SYS, the microprocessor 101 outputs the second control signal to the switch control unit 107, to turn off the monitor 100.

When the monitor 100 works, if the infrared sensor U3 detects the user of the computer does not exist in front of the monitor 100, and the infrared sensor U3 outputs a low level signal to the inverting input terminal of the amplifier U2. The output terminal of the amplifier U2 outputs a high level signal to the FET Q. The gate of the FET Q receives the high level signal, and the FET Q is turned on. At the same time, the input/output pin P2.1 of the microprocessor 101 receives a low level signal. Namely, the input/output pin P2.1 of the microprocessor 101 does not receive the system voltage 5V_SYS. The microprocessor 101 outputs the second control signal to the switch control unit 107, to turn off the monitor 100. When the user returns back to the front of the monitor, the infrared sensor U3 detects the user exists in front of the monitor 100, and outputs a high level signal to the inverting input terminal of the amplifier U2. The output terminal of the amplifier U2 outputs a low level signal to the FET Q. The gate of the FET Q receives the low level signal, and the FET Q is turned off. At the same time, the input/output pin P 2.1 of the microprocessor 101 receives the system voltage 5V_SYS. The microprocessor 101 outputs the first control signal to the switch control unit 107, to control the monitor 100 to return back to work.

In use, when the environment brightness changes, the brightness sensor U1 detects the environment brightness state around the monitor 100, and sends the brightness state to the microprocessor 101. The microprocessor 101 gains the current brightness state of the monitor 100 from the display control unit 102, and compares the current brightness state with the received environment brightness state of the monitor 100 output from the brightness sensor U1, and outputs a brightness control signal to the display control unit 102, to regulate the brightness of the monitor 100 according to the brightness control signal. Therefore, the monitor 100 can protect the eyes of the user and save energy.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching. The embodiments were chosen and described in order to explain the principles of the disclosure and their practical application so as to enable others skilled in the art to utilize the disclosure and various embodiments and with various modifications as are suited to the particular use contemplated. Alternately embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A monitor comprising:

a microprocessor;

a switch control unit;

an infrared sensor;

a switch detecting unit to receive a system voltage, and send the system voltage to the microprocessor;

wherein when the microprocessor detects the presence of the system voltage, the microprocessor outputs a first control signal to the switch control unit to control the monitor to be turned on, wherein when the microprocessor detects the system voltage not being present, the microprocessor outputs a second control signal to the switch control unit to control the monitor to be turned off;

a display control unit; and a brightness detecting unit to detect an environment brightness state around the monitor and send the environment brightness state to the microprocessor;

wherein the microprocessor compares the received environment brightness state output from the brightness detecting unit with a current brightness state of the monitor output from the display control unit, and outputs a brightness control signal to the display control unit to regulate the brightness of the monitor; wherein the switch detecting unit comprises a first capacitor, a field effect transistor (FET), a diode, an amplifier, and first to sixth resistors, wherein a first input/output pin of the microprocessor is grounded via the first capacitor, connected to the system voltage via the first resistor, and connected to the drain of the FET, the source of the FET is grounded, the second resistor is connected between the first input/output pin of the microprocessor and the source of the FET, an anode of the diode is connected to the source of the FET, a cathode of the diode is connected to the drain of the FET, the gate of the FET is connected to an output terminal of the amplifier, a voltage terminal of the amplifier is connected to an inside power of the monitor, the third and the fourth resistors are connected in series between the voltage terminal of the amplifier and ground, a non-inverting input terminal of the amplifier is connected to a node between the third resistor and the fourth resistor, an inverting input terminal of the amplifier is connected to a first pin of the infrared sensor and grounded via the fifth resistor, a ground pin of the amplifier is connected to a second pin of the infrared sensor and ground, a third pin of the infrared sensor is connected to the voltage terminal of the amplifier via the sixth resistor.

2. The monitor of claim 1, wherein when the monitor is turned on, the switch detecting unit detects whether a user exists in front of the monitor through the infrared sensor, if the user does not exist in front of the monitor, the microprocessor receives the system voltage which is reduced to a low level by the switch detecting unit, the microprocessor outputs the second control signal to the switch control unit to control the monitor to be turned off, if the user returns back to the front of the monitor, the microprocessor receives the system voltage, the microprocessor outputs the first control signal to the switch control unit to control the monitor to be turned on.

3. The monitor of claim 1, wherein the brightness detecting unit comprises a brightness sensor and a seventh resistor, a receiving pin of the microprocessor is connected to a data pin of the brightness sensor via the seventh resistor, a transmitting pin of the microprocessor is connected to a clock pin of the infrared sensor, a voltage pin of the brightness sensor is connected to the inside power of the monitor, a ground pin of the brightness sensor is connected to a ground pin of the microprocessor, and grounded.

4. The monitor of claim 3, further comprising a display switch unit to control the monitor to be turned on or turned off by manual operation, wherein the display switch unit comprises a first switch, a second capacitor, and an eighth resistor, the inside power of the monitor is grounded via the second capacitor and the eighth resistor in sequence, a second input/output pin of the microprocessor is connected to a node between the second capacitor and the eighth resistor and connected to the inside power of the monitor via the first switch.

5. The monitor of claim 4, wherein the microprocessor is a single-chip.

6. The monitor of claim 4, further comprising a clock unit to provide work clock signals to the microprocessor, wherein the clock unit comprises a crystal oscillator, third and fourth capacitors, a first clock pin of the microprocessor is grounded via the third capacitor, a second clock pin of the microprocessor is grounded via the fourth capacitor, the crystal oscillator is connected between the first clock pin and the second clock pin of the microprocessor.

7. The monitor of claim 6, further comprising a reset unit to reset the microprocessor, wherein the reset unit comprises a second switch, a fifth capacitor, ninth and tenth resistors, a power pin of the microprocessor is connected to the inside power of the monitor via the ninth resistor, a voltage pin of the microprocessor is connected the inside power of the monitor and grounded via the fifth capacitor and the tenth resistor in sequence, a first terminal of the second switch is connected to a node between the fifth capacitor and the tenth resistor, a second terminal of the switch is connected to the inside power of the monitor.

* * * * *